US007360829B2

(12) United States Patent
Bufkin

(10) Patent No.: US 7,360,829 B2
(45) Date of Patent: Apr. 22, 2008

(54) CHAIR-MOUNTABLE TABLE

(76) Inventor: William J. Bufkin, P.O. Box 180051, Tallahassee, FL (US) 32318

( * ) Notice: Subject to any disclaimer, the term of this patent is extended or adjusted under 35 U.S.C. 154(b) by 724 days.

(21) Appl. No.: 10/724,958

(22) Filed: Dec. 1, 2003

(65) Prior Publication Data

US 2005/0116514 A1 Jun. 2, 2005

(51) Int. Cl.
*A47B 83/02* (2006.01)

(52) U.S. Cl. ..... 297/162; 297/411.23; 297/411.32

(58) Field of Classification Search ..... 297/162, 297/173, 188.14, 188.15, 188.18, 411.23, 297/411.32, 411.34
See application file for complete search history.

(56) References Cited

U.S. PATENT DOCUMENTS

| | | | | |
|---|---|---|---|---|
| 2,477,898 | A * | 8/1949 | Irving et al. | 248/118 |
| 3,547,488 | A * | 12/1970 | Barnes | 297/162 |
| 3,598,442 | A * | 8/1971 | Miller | 297/22 |
| 5,022,706 | A * | 6/1991 | Bryan | 297/162 |
| 5,135,190 | A * | 8/1992 | Wilson | 248/118.1 |
| 5,333,929 | A * | 8/1994 | Slagerman | 297/155 |
| 5,335,888 | A * | 8/1994 | Thomsen | 248/118.5 |
| 5,383,632 | A * | 1/1995 | Shirlin et al. | 248/118.5 |
| 5,490,710 | A * | 2/1996 | Dearing et al. | 297/162 |
| 5,653,499 | A | 8/1997 | Goodall | |
| 5,718,671 | A * | 2/1998 | Bzoch | 602/20 |
| 5,727,759 | A | 3/1998 | Christensen | |
| 5,752,683 | A * | 5/1998 | Novis et al. | 248/118 |
| 6,074,012 | A * | 6/2000 | Wu | 297/411.26 |
| 6,206,464 | B1 | 3/2001 | Santa Rosa et al. | |
| 6,262,150 | B1 | 7/2001 | Behi et al. | |
| 6,264,272 | B1 | 7/2001 | Jones et al. | |
| 6,311,939 | B1 | 11/2001 | Christensen | |
| 6,347,771 | B1 * | 2/2002 | Lauzon et al. | 248/118 |
| 6,352,303 | B1 | 3/2002 | Hope | |
| 6,375,257 | B1 * | 4/2002 | Wooding et al. | 297/162 |
| 6,526,896 | B2 | 3/2003 | Woronecki et al. | |
| 6,578,914 | B2 * | 6/2003 | Artsvelyan | 297/219.1 |
| 6,592,085 | B2 * | 7/2003 | Iwata et al. | 248/118.1 |
| 6,827,405 | B1 * | 12/2004 | Roberts | 297/411.23 |

* cited by examiner

*Primary Examiner*—Joe Edell
(74) *Attorney, Agent, or Firm*—J. Wiley Horton

(57) ABSTRACT

A small mouse table integrated with an ergonomic arm support. The table and arm support can be mounted to a conventional arm rest on an office chair. The arm support and table are positioned in order to place the user's arm in a healthy and stable orientation for use of the mouse. A forearm channel is provided to receive and hold the user's forearm. A wrist channel is provided—in combination with a downward offset—to attach the forearm channel to the small table on which the mouse resides. Two pivot joints are provided so that the mouse table can be swung out of the way when it is not needed.

18 Claims, 17 Drawing Sheets

CHAIR-MOUNTABLE TABLE

BACKGROUND OF THE INVENTION

1. Field of the Invention

This invention relates to the field of furniture accessories. More specifically, the invention comprises an integrated arm support and table which can be mounted on a variety of chairs.

2. Description of the Related Art

The "mouse" has now become a very common computer interface device. Some computer users, particularly those running Computer-Aided Design ("CAD") programs, use a mouse far more often than any other device. A mouse is typically placed next to a video monitor and keyboard. This constraint can be troublesome, since it often requires the user to lean forward over a desk in order to keep his or her right hand on the mouse. Some CAD operators may maintain this position for many hours, resulting in back and eye strain. Repetitive motion injuries may also result.

"Wireless" mice have become common in recent years. These devices can communicate with the computer without being attached by a cord. Thus, they can be moved off the computer's desk and several feet away. However, because a mouse must move across a relatively flat surface in order to function, even a wireless mouse often remains on the desk. If a suitable flat surface is provided as part of the user's chair, however, a much more comfortable working position is possible.

BRIEF SUMMARY OF THE INVENTION

The present invention comprises a small mouse table integrated with an ergonomic arm support. The table and arm support can be mounted to a conventional arm rest on an office chair. The arm support and table are positioned in order to place the user's arm in a healthy and stable orientation for use of the mouse.

A forearm channel is provided to receive and hold the user's forearm. A wrist channel is provided—in combination with a downward offset—to attach the forearm channel to the small table on which the mouse resides. Two pivot joints are provided so that the mouse table can be swung out of the way when it is not needed.

REFERENCE NUMERALS IN THE DRAWINGS

| | | | |
|---|---|---|---|
| 10 | arm support | 12 | mouse table |
| 14 | forearm channel | 16 | wrist channel |
| 18 | arm rest cover | 20 | mouse surface |
| 22 | angled pivot joint | 24 | offset |
| 26 | side extension | 28 | mounting unit |
| 30 | horizontal pivot joint | 32 | top wall |
| 34 | side wall | 36 | strap anchor |
| 38 | top relief | 40 | side relief |
| 42 | strap | 44 | strap journal |
| 46 | lock | 48 | chair |
| 50 | arm rest | 52 | tube |
| 54 | pivot bracket | 56 | angled pivot joint |
| 58 | mouse rest | 60 | mouse pad |
| 62 | mouse | 64 | adjustment block |
| 66 | arm rest loop | 68 | lip |
| 70 | keyboard rest | 72 | recess |

DETAILED DESCRIPTION OF THE INVENTION

Figure 1:
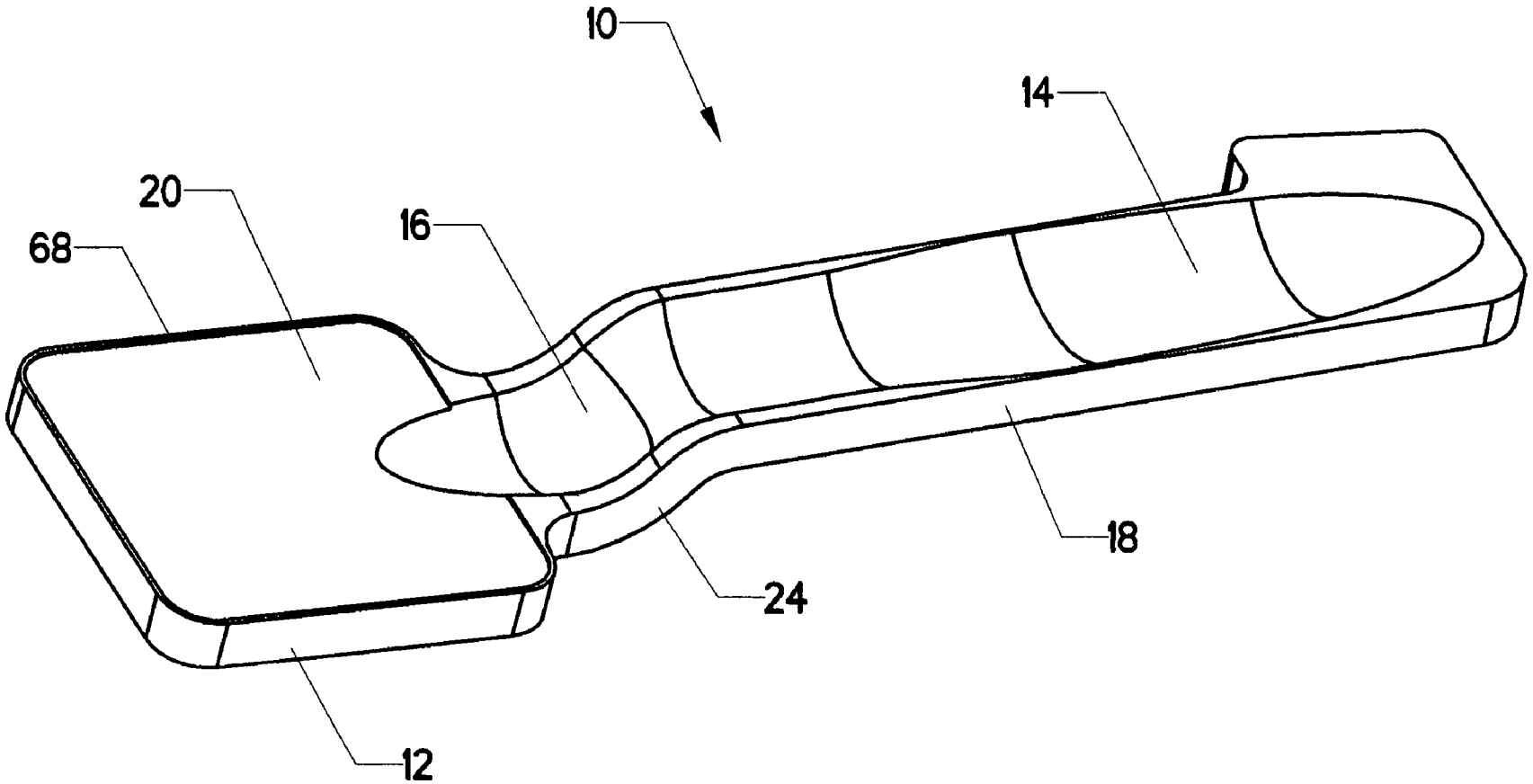
FIG. 1 is an isometric view, showing the upper unit.

The present invention comprises an integrated arm rest and mouse table designed to be attached to a chair. FIG. 1 shows the portion of the device which the user will frequently touch—arm support 10. It includes two main portions, mouse table 12 and arm rest cover 18. The two portions are preferably joined by offset 24, the purpose of which will be explained subsequently.

Figure 8:
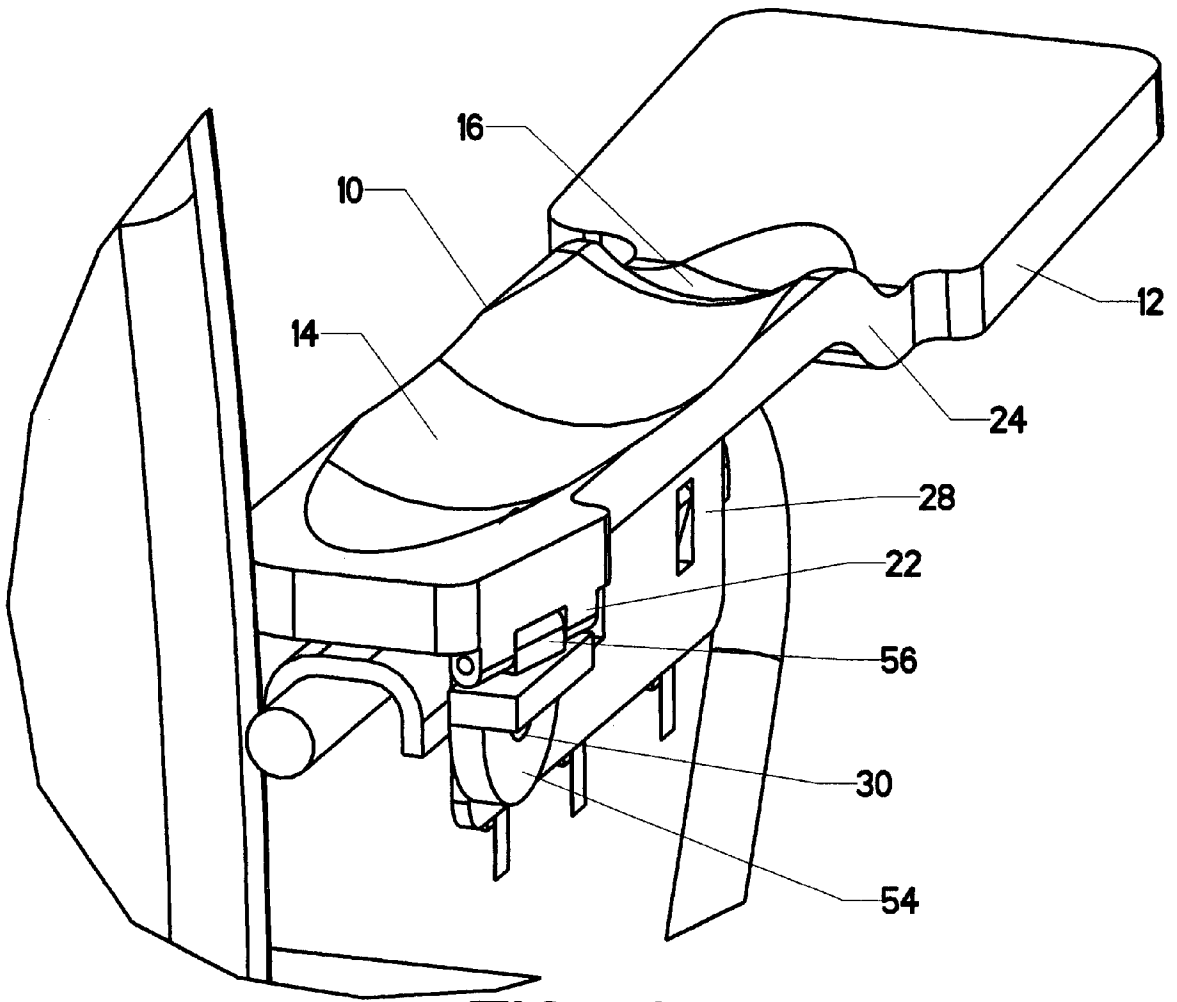
FIG. 8 is an isometric view, showing the entire assembly attached to a chair.
Figure 9:
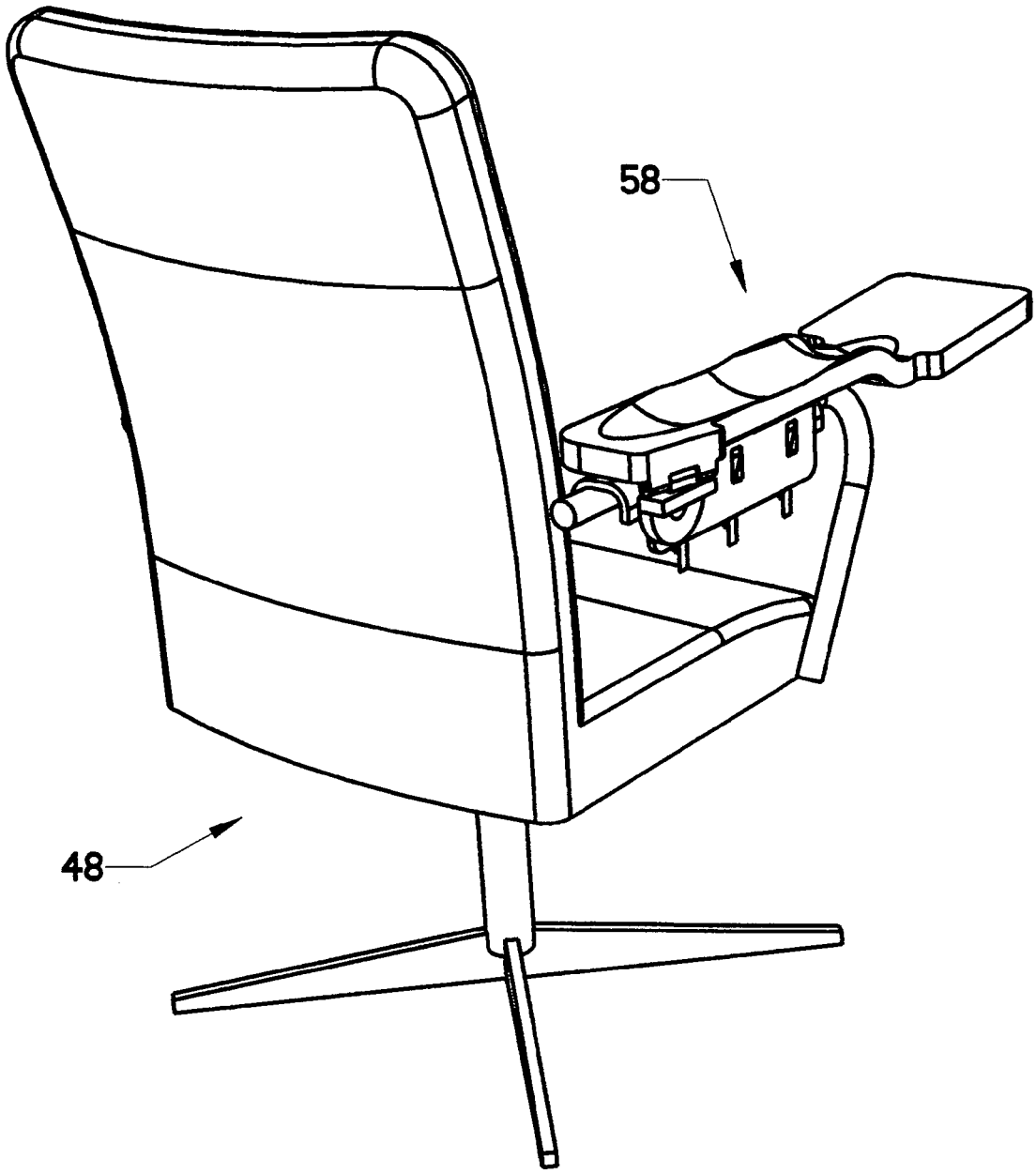
FIG. 9 is a perspective view, showing the entire assembly attached to a chair.

Looking briefly at FIG. 9, the reader will see how arm support 10 is intended to be attached to a chair. The user will rest his or her arm, wrist, and hand on the upper surfaces of the device. Thus, the ergonomic attributes of these upper surfaces are significant. Returning now to FIG. 1, the reader will observe that forearm channel 14 runs along the length of arm rest cover 18. It joins into wrist channel 16 in the region of offset 24. Wrist channel 16 runs down offset 24 and blends into mouse surface 20 (the surface on which the computer mouse will operate). Looking at FIG. 8, the reader can better visualize the contours of these blended surfaces.

In operation, the portion of the user's forearm which is near the elbow joint remains relatively stationary. However, the portion near the wrist must move from side to side. The wrist must also be able to flex in order to move the mouse over its normal range. Forearm channel 14 tends to stabilize the aft portion of the forearm, while allowing the wrist to move. Offset 24 is provided to follow the natural contour of the wrist (when the wrist is gripping an object such as a mouse).

Returning now to FIG. 1, the reader will note that mouse table 12 is preferably inclined slightly upward, in order to place the wrist and hand in a desired orientation. The pitch of the mouse table can be made adjustable with respect to the arm rest cover in order to accommodate varying user preferences. Lip 68 (a raised rib running around the table's perimeter) is preferably provided to retain things placed on the mouse table.

Figure 2:
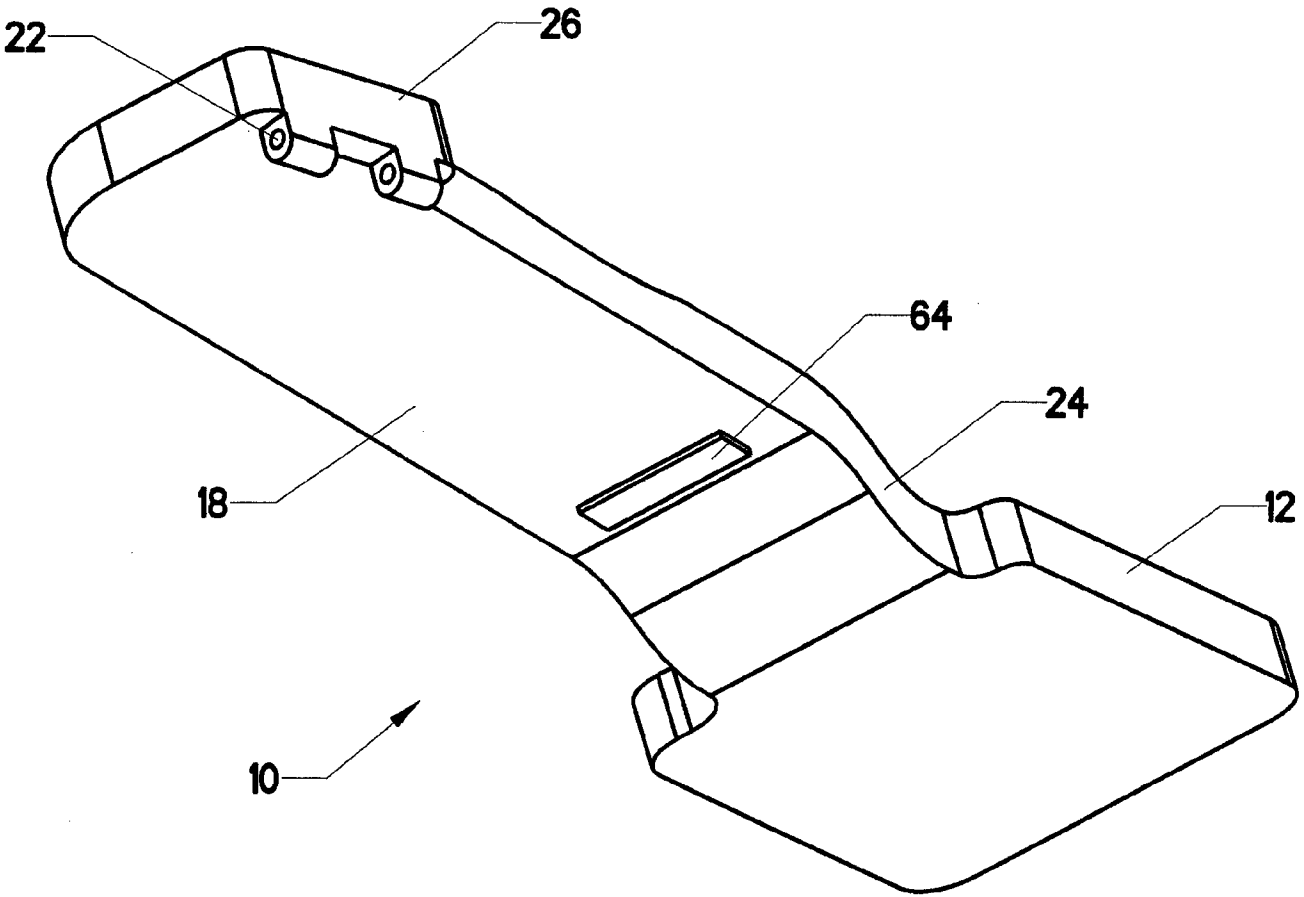
FIG. 2 is an isometric view, showing the upper unit from a different perspective.

The reader will appreciate that mounting hardware is needed to attach the arm support to a chair. The reader will also appreciate that the arm support will not always be in use. It is therefore desirable to provide a convenient storage means. FIG. 2 shows arm support 10 from the underside. Adjustment block 64 is optionally provided to adjust the pitch of arm support 10 when it is in use. Side extension 26 on the aft portion of arm rest cover 18 mounts angled pivot joint 22, which is used to connect the arm support to the other mounting components.

Figure 3:
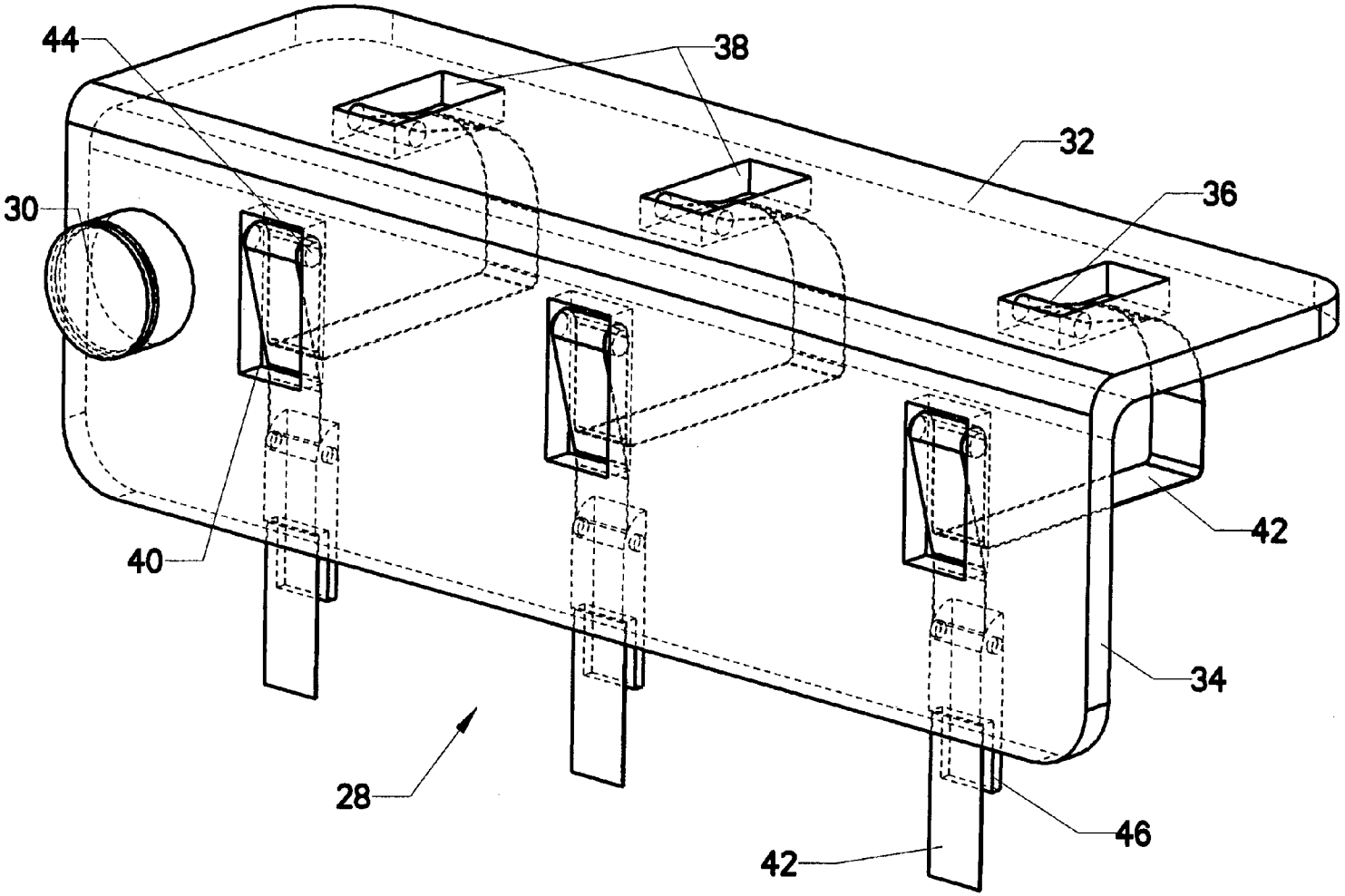
FIG. 3 is an isometric view, showing the mounting unit.

FIG. 3 shows the component which attaches directly to the chair—mounting unit 28. It comprises top wall 32 and side wall 34. This "L" shaped component is attached to the arm rest of a chair using a plurality of straps 42. Each strap has a fixed end and a free end. The fixed end is attached at a strap anchor 36, which is found within a top relief 38 (The top relief allows the strap to move to any number of desirable orientations). The free end is passed around the arm rest, over a strap journal 44, and through a lock 46. After it is pulled tight, lock 46 is locked to grasp the strap and hold it firmly.

Figure 4:
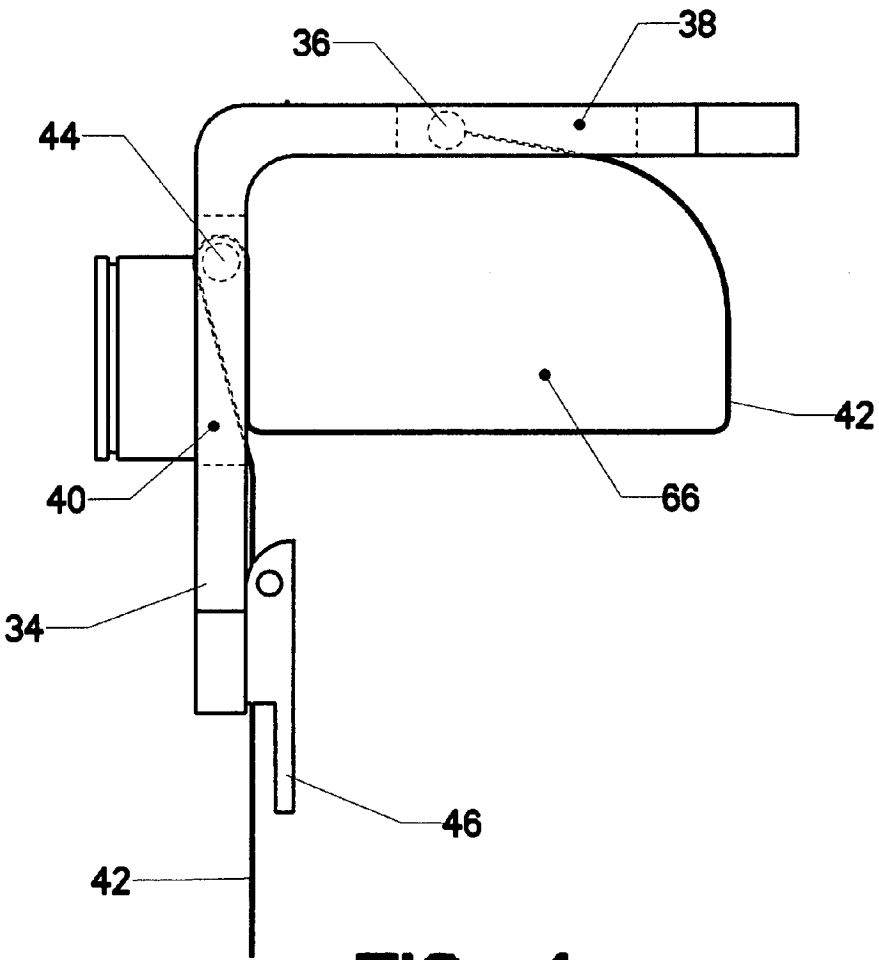
FIG. 4 is an elevation view, showing the mounting unit.

The strap journals 44 are preferably located in side wall 34. Side reliefs 40 are provided to allow the strap to freely pass around the strap journal. Side wall 34 also mounts horizontal pivot joint 30, the purpose of which will be explained subsequently. FIG. 4 shows an elevation view of the same device. The reader will observe how strap 42 can form an armrest loop 66. Those skilled in the art will realize that strap anchor 36 and strap journal 44 are positioned so that when strap 42 is tightened, top wall 32 and side wall 34 will be drawn against an object lying within armrest loop 66.

Figure 5:
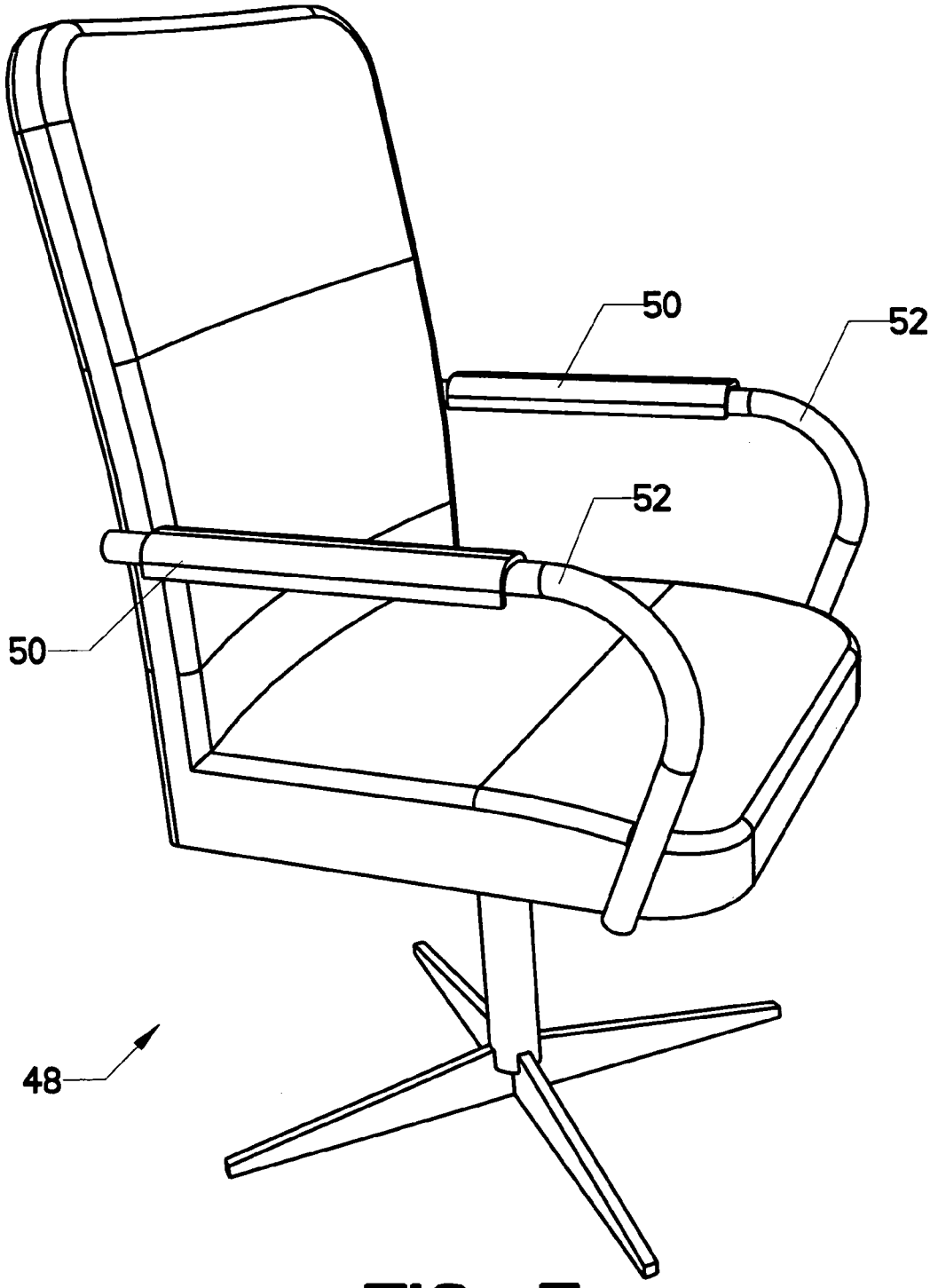
FIG. 5 (PRIOR ART)
FIG. 5 is a perspective view, showing a chair.

FIG. 5 shows chair 48, Its arm rest structure is provided by tube 52, which is covered by arm rest 50. Many types of chairs are in common use. However, most chairs have some type of arm rest structure which is generally similar to that shown in FIG. 5.

Figure 6:
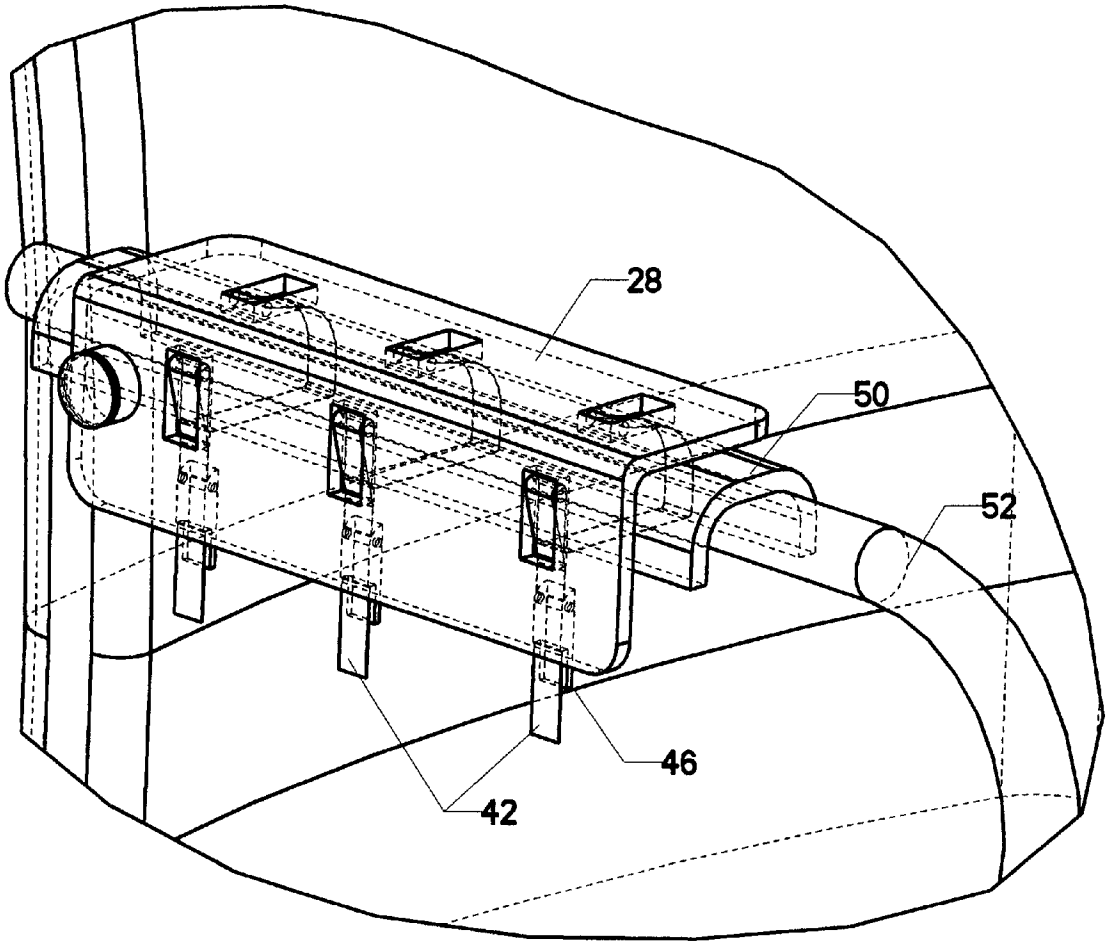
FIG. 6 is a hidden fine view, showing the mounting unit attached to a chair.

FIG. 6 shows mounting unit 28 attached to arm rest 50. The three straps 42 have been passed around arm rest 50, over the three strap journals 44, and locked into the three locks 46 (Any number of straps can be provided, but three straps work well in most applications). Mounting unit 28 is thereby locked in position on the chair. The devices which attach the arm support to the mounting unit will now be described in detail.

Figure 7:
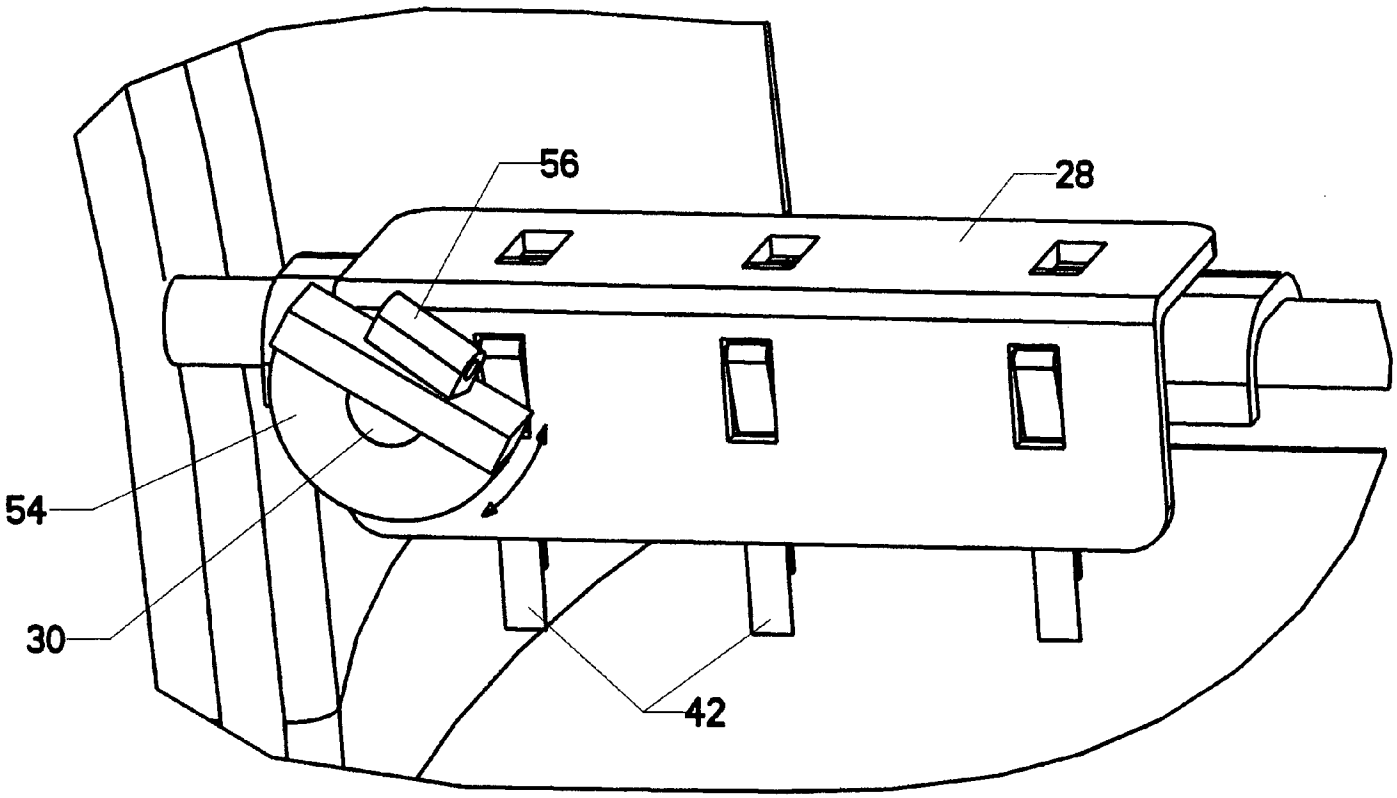
FIG. 7 is an isometric view, showing the pivot bracket attached to the mounting unit.

FIG. 7 shows pivot bracket 54 pivotally attached to horizontal pivot joint 30. It pivots as shown by the reciprocating arrows. It may be locked onto pivot joint 30 by a retaining ring, a set screw, or other conventional mechanical features. Pivot bracket 54 has an upper portion which mounts angled pivot joint 56. This upper portion pivots over a range which includes at least a substantially horizontal orientation and a substantially vertical orientation.

FIG. 8 shows the complete assembly. Arm support 10 is pivotally mounted to pivot bracket 54 by the attachment of angled pivot joint 22 to angled pivot joint 56. A pivot pin is secured in the joint using a retaining clip, a pair of locking nuts, or other conventional features. The reader will observe that the angled pivot joint formed is angularly offset from the long axis of arm support 10. This feature is not critical, but is desirable. An aligned pivot joint could be used, but the addition of the angular offset allows clearance for different arm rests, as will be described in the following.

FIG. 9 shows a complete view of mouse rest 58 (the complete assembly) attached to chair 48. The configuration shown is how the device will be oriented when in use (for a right-handed user). When the mouse is not in use, however, the configuration shown impedes the normal use of the chair. Thus, it is desirable to stow the mouse table out of the way. FIGS. 10-13 illustrate the stowage process.

Figure 10:
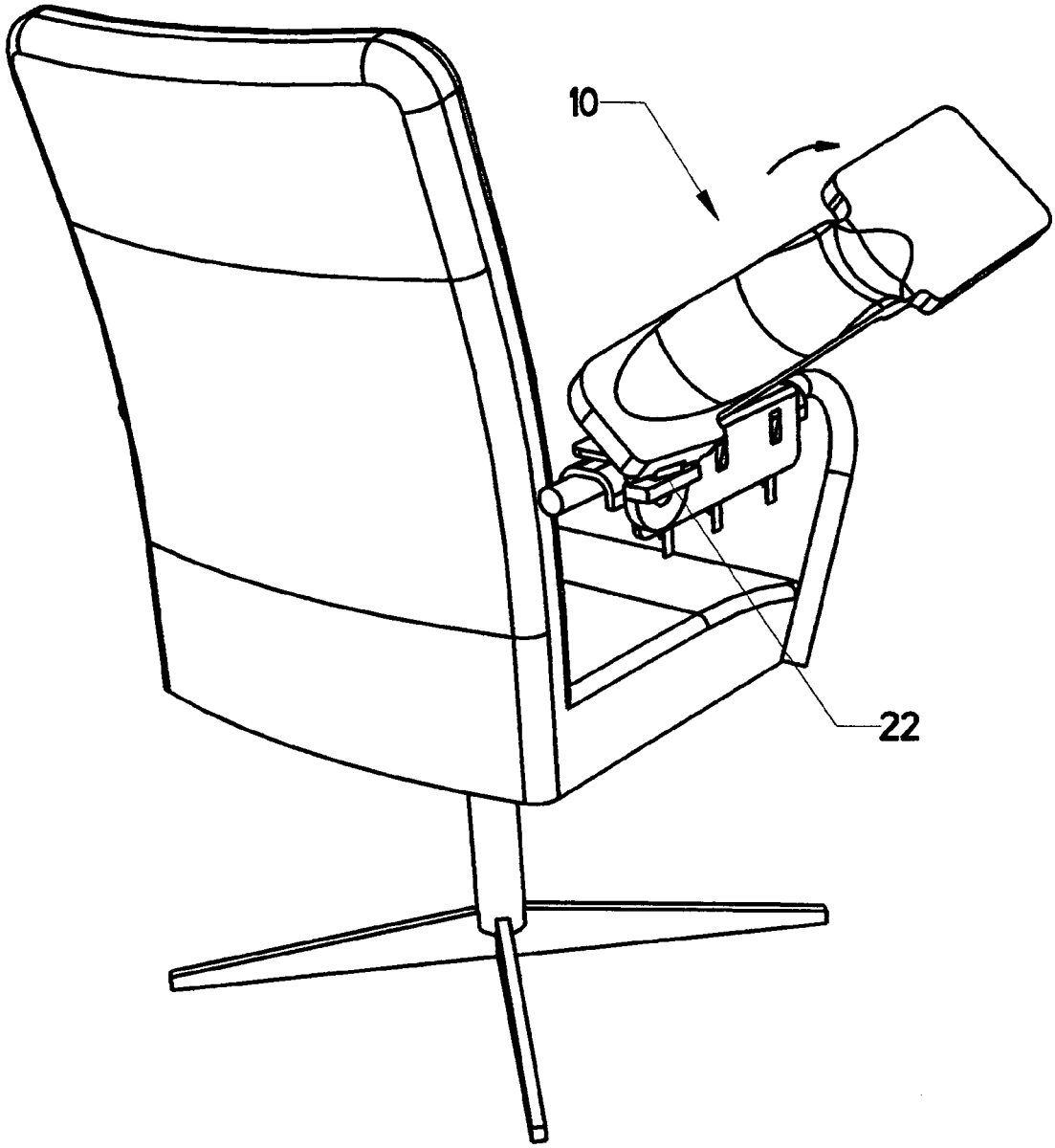
FIG. 10 is a perspective view, showing the process of swinging the mouse table away for storage.
Figure 11:
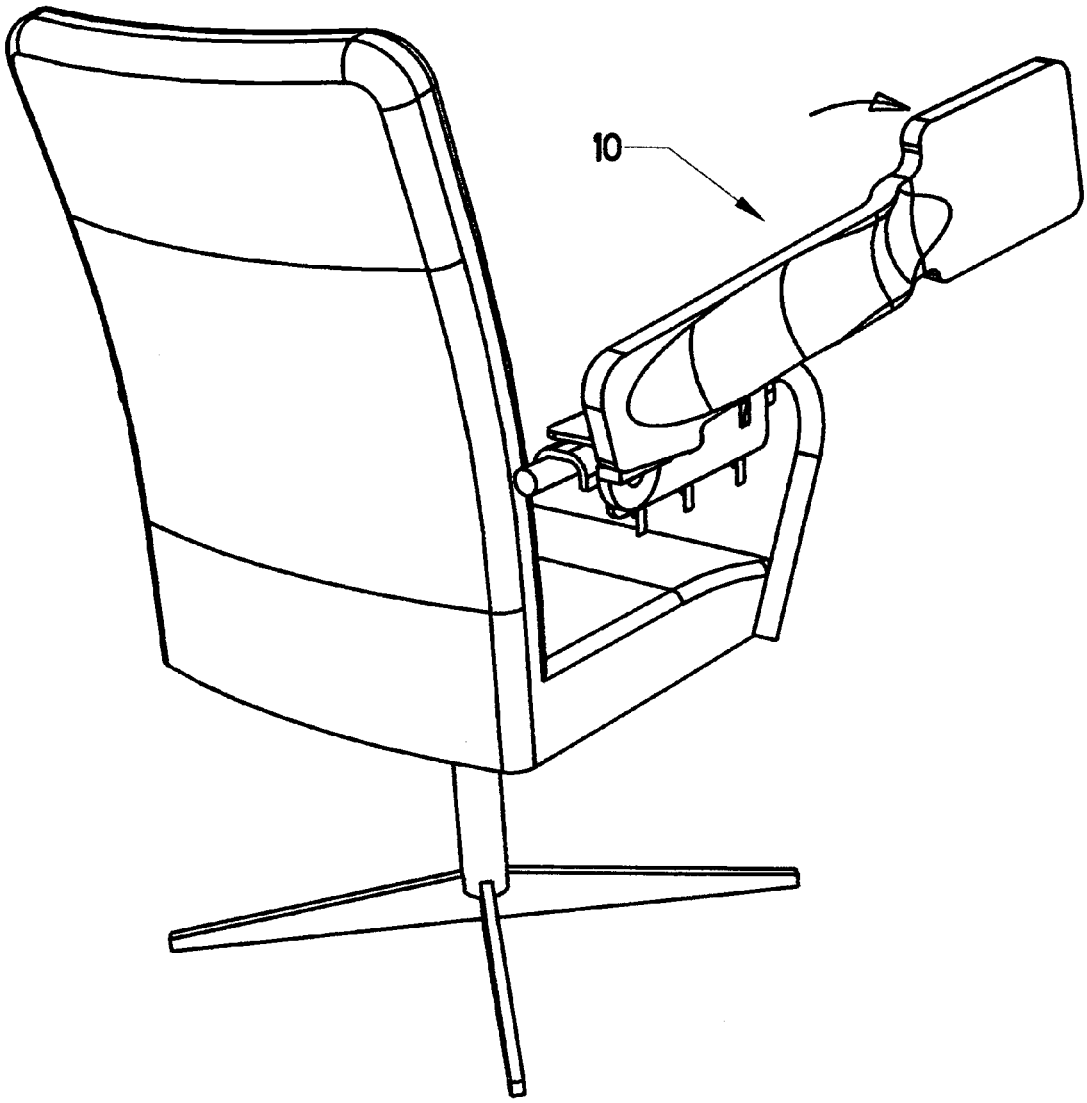
FIG. 11 is a perspective view, showing the process of swinging the mouse table away for storage.
Figure 12:
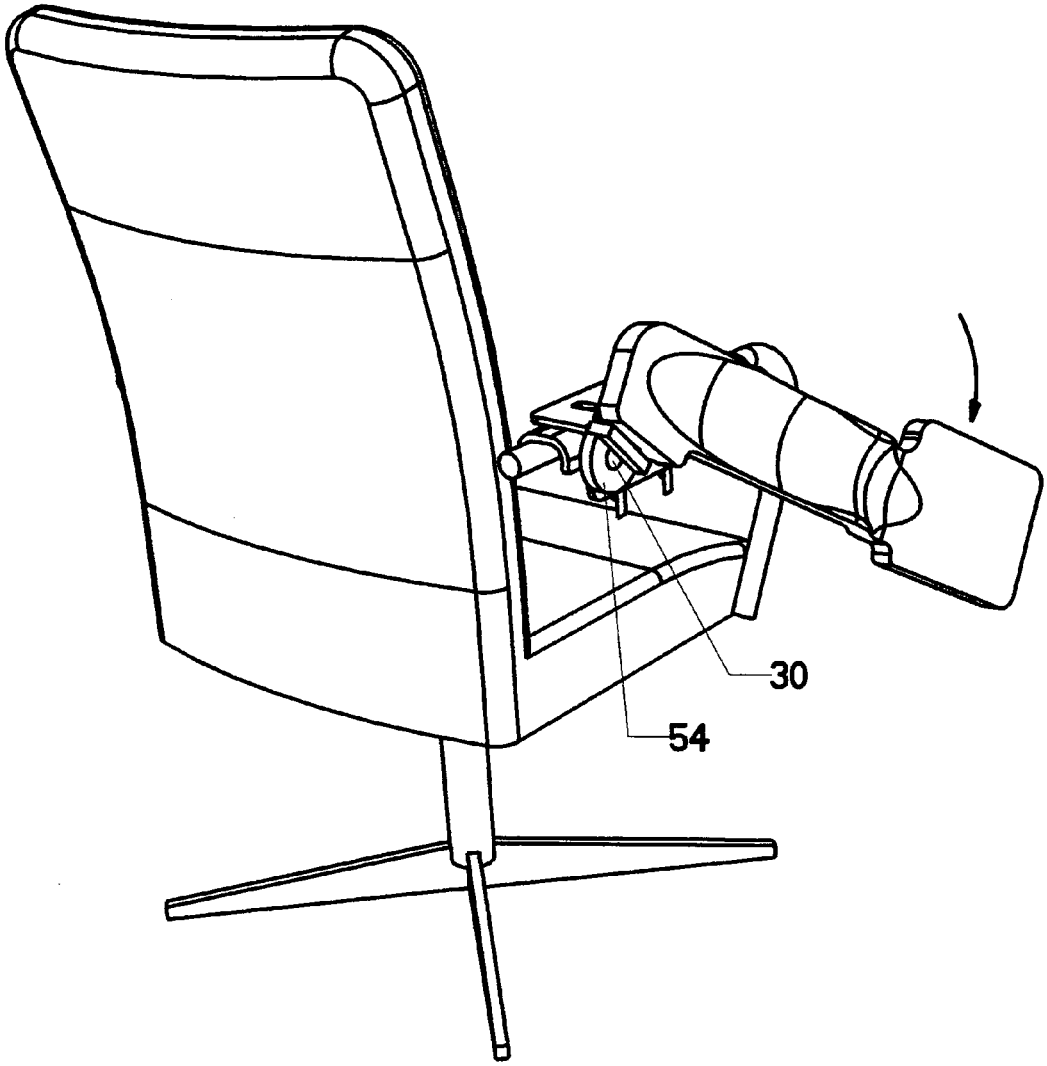
FIG. 12 is a perspective view, showing the process of swinging the mouse table away for storage.

In FIG. 10, the user has grasped arm support 10 and pivoted it upward via the operation of angled pivot joint 22. In FIG. 11, the rotation has continued until arm support 10 is in a substantially vertical orientation. The user then begins pivoting arm support 10 downward via pivoting about horizontal pivot joint 30. FIG. 12 shows the arm support pivoted part way down via the fact that pivot bracket 54 has pivoted about horizontal pivot joint 30.

Figure 12B:
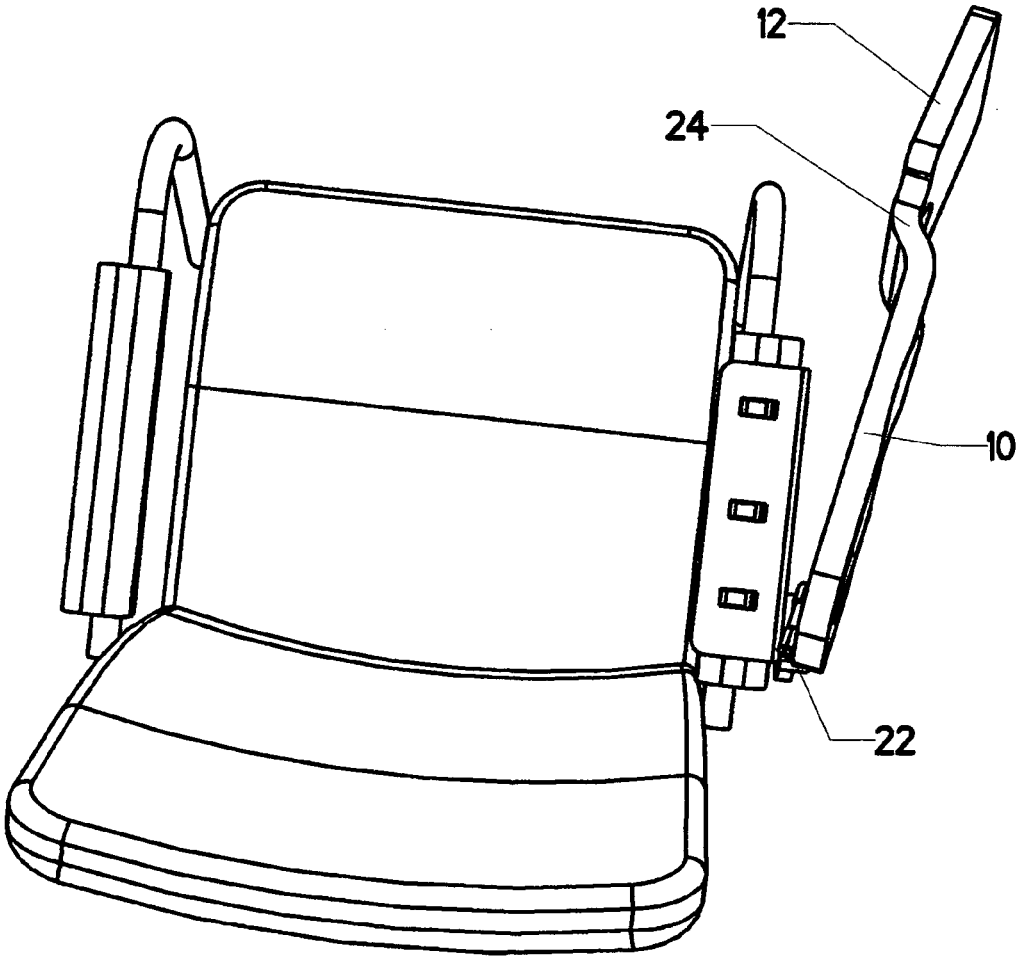
FIG. 12B is a perspective view, showing the process of swinging the mouse table away for storage.

The description of motion will now be briefly interrupted to explain the advantage of using angled pivot joint 22. FIG. 12B shows a top view of the same configuration shown in FIG. 12. The reader will observe how the use of angled pivot joint 22 rotates arm support 10 outward during the stowing process. This rotation swings mouse table 12 well clear of the chair's arm rest. While the feature might not be needed for the particular arm rest shown (which is fairly slim), many arm rests include wider portions toward the forward end. Extra clearance is therefore needed, especially considering the presence of offset 24. Thus, the use of the angled pivot joint is preferable. However, the reader should be aware that the term "angled pivot joint," as used in this disclosure, is intended to cover many different angles. In some embodiments, the angled pivot joint may lie perfectly parallel to the chair's arm rest. In other words, there would be an angular offset of 0 degrees between the angled pivot joint and the long axis of the chair's arm rest.

Figure 13:
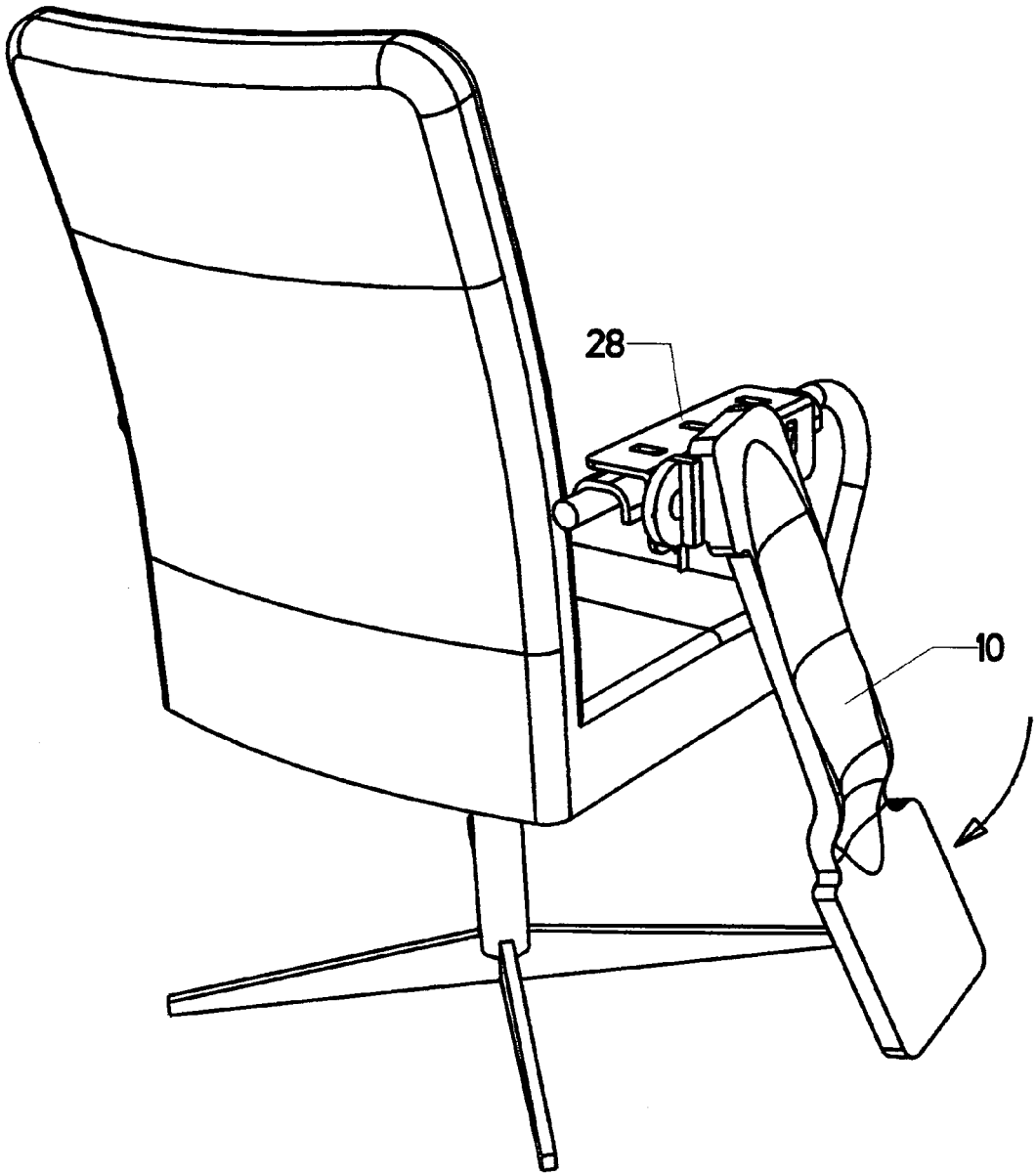
FIG. 13 is a perspective view, showing the process of swinging the mouse table away for storage.

FIG. 13 shows arm support 10 swung downward to the stowed position. Mechanical stops can be used at both the angled pivot joint and the horizontal pivot joint to prevent unwanted over-travel. The reader will observe that the upper surface of mounting-unit 28 then becomes the chair's arm rest. As it does not include protrusions, it can serve for this purpose.

Figure 14:
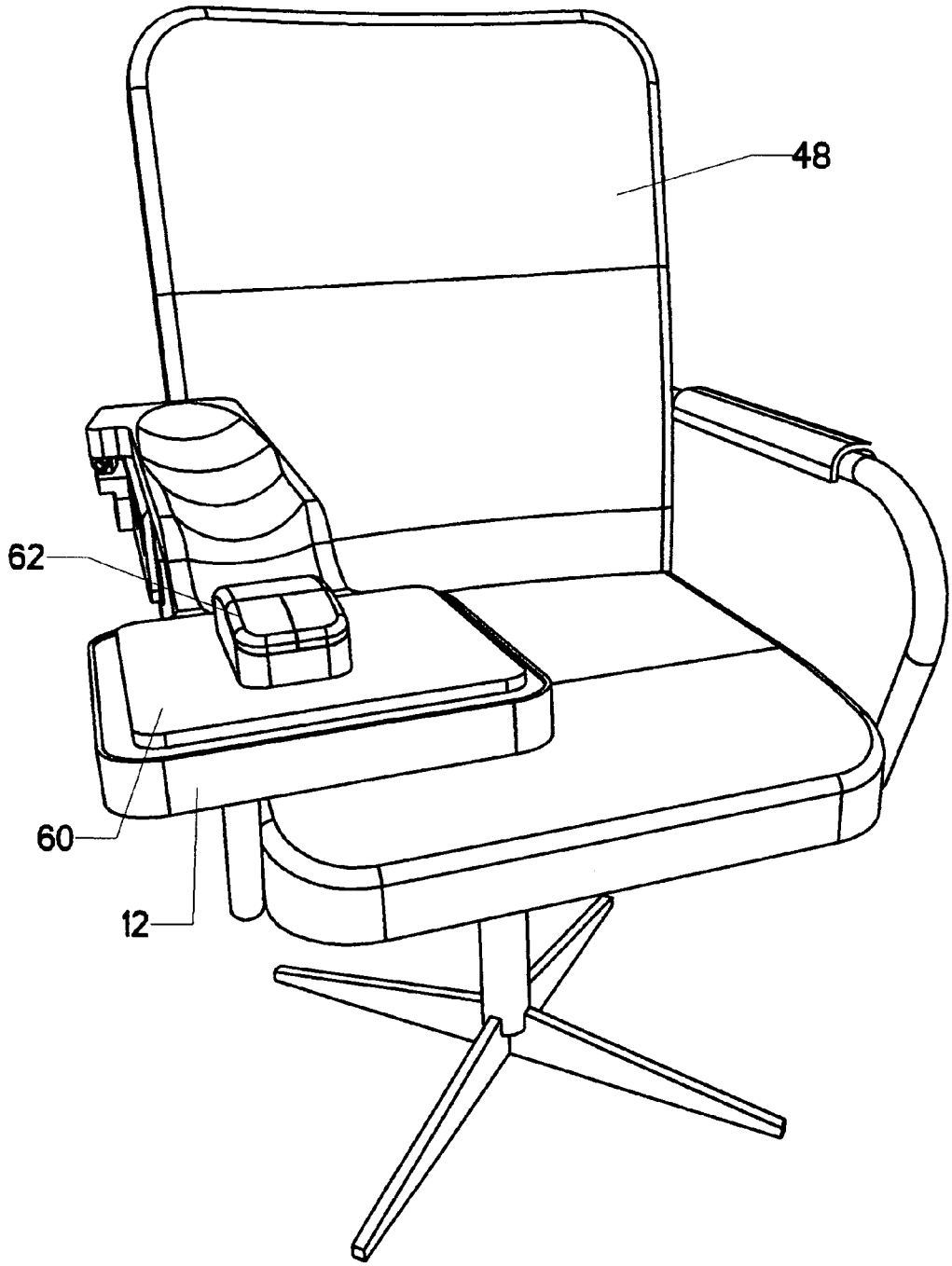
FIG. 14 is a perspective view, showing the table in use.

To redeploy the mouse table, the opposite process is used. FIG. 14 shows mouse table 12 in position for use. A mouse pad 60 and mouse 62 are shown in position. Those skilled in the art will realize that the version shown is best suited to a right-handed user. It is possible to make the device ambidextrous by centering the mouse table on the arm support and provided pivot joints on both sides of the arm support and the mounting unit. It is also possible to simply make a left-handed version (which is a mirror image of the version shown).

The reader will by now understand that the underside of the arm support rests on the upper surface of the mounting unit when in the position shown in FIG. 14. The overall pitch of the arm support can be adjusted to suit the user's preference by inserting adjustment blocks 64 (shown in FIG. 2) of varying thicknesses. These adjustment blocks can be bonded to the underside of the arm support by double sided tape or other conventional means. An adjustment screw or wedge could likewise be substituted. It is also possible to insert a third pivot joint between the arm rest cover and the mouse table, so that the pitch of the mouse table can be adjusted independently. All these variations will be within the understanding of those skilled in the art.

Figure 15:
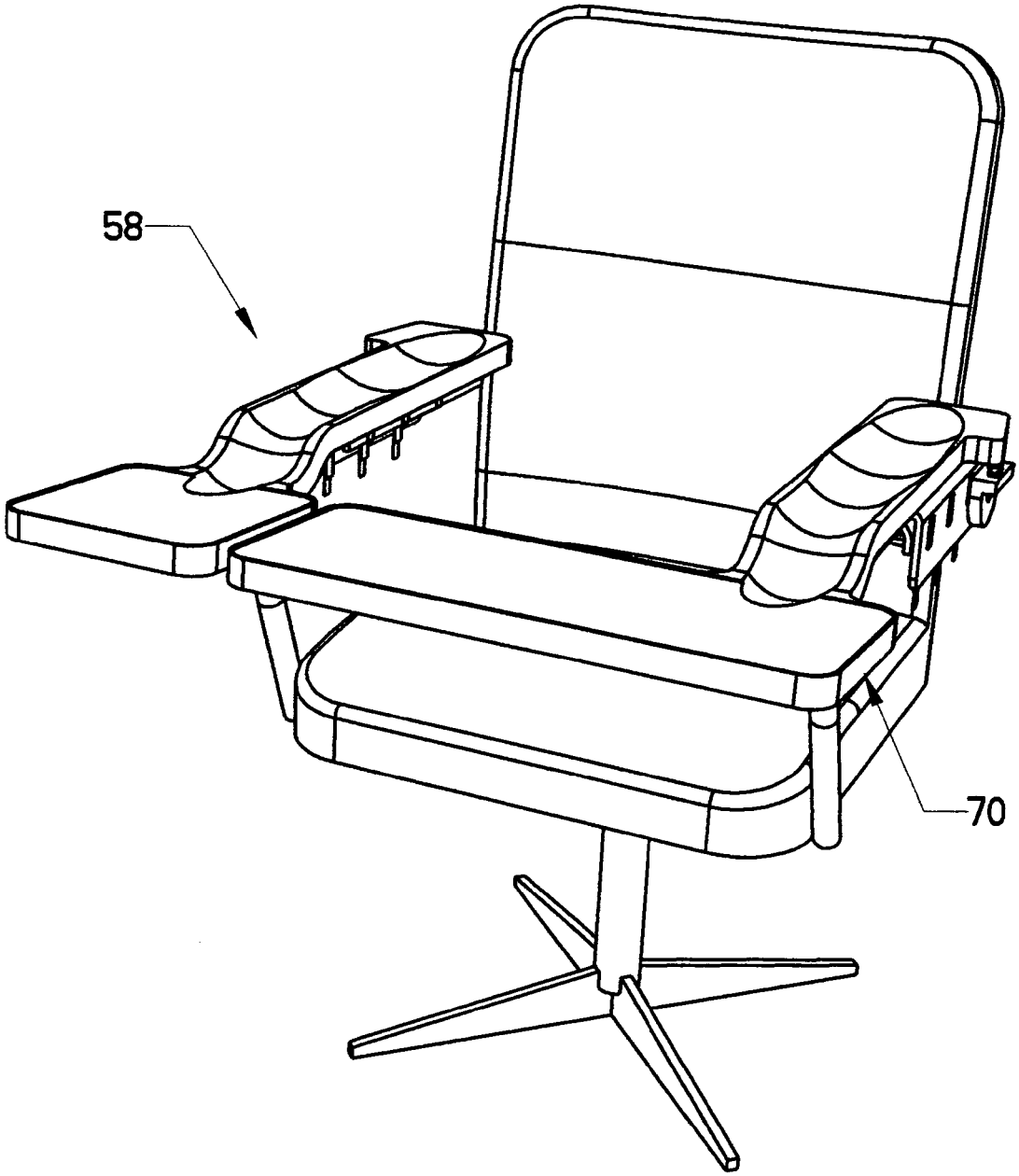
FIG. 15 is a perspective view, showing the addition of a keyboard table to the invention.

In some applications, it will be desirable for the user to have both a mouse and a keyboard attached to the chair. This desire can be accommodated by attaching two of the table units. FIG. 15 shows this embodiment. The chair shown has mouse rest 58 attached to the right arm rest and keyboard rest 70 attached to the left arm rest. Keyboard rest 70 is a mirror image of mouse rest 58, except that the table portion is made much wider so that it can support a keyboard. The table folds away to the left side of the chair, just as the mouse rest folds away to the right side of the chair.

Figure 16:
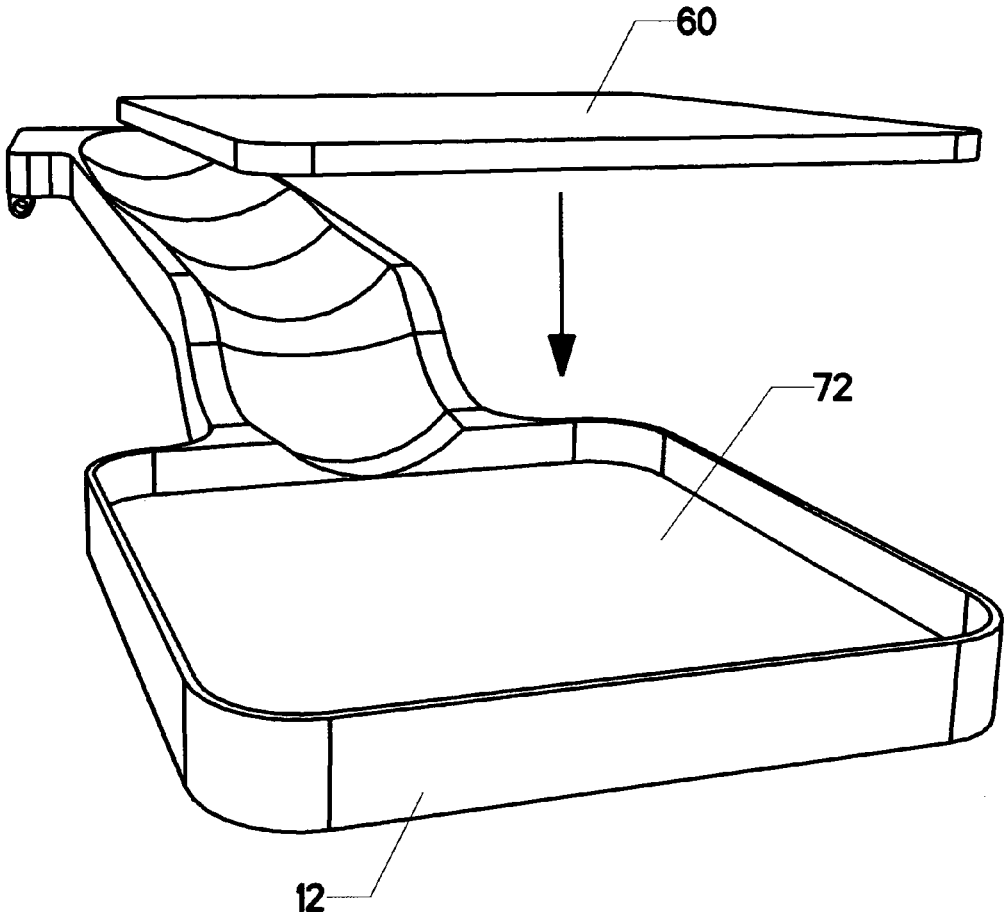
FIG. 16 is a perspective view, showing the addition of a recess in the table.

Although the use of a retaining lip around the perimeter of the table may secure the mouse pad, it may be desirable to add a further restrain to prevent the mouse itself from slipping off the table. FIG. 16 shows an alternate embodiment for mouse table 12 which addresses this concern. Recess 72 has been cut into the table's upper surface. This recess is deeper than the thickness of mouse pad 60. Thus, when mouse pad 60 is placed within recess 72, a bounding wall around the table's perimeter will stick up beyond the upper surface of the mouse pad. This bounding wall will serve to keep the mouse on the table.

The preceding description contains significant detail regarding the novel aspects of the present invention. It is should not be construed, however, as limiting the scope of the invention but rather as providing illustrations of the preferred embodiments of the invention. Thus, the scope of the invention should be fixed by the following claims, rather than by the examples given.

Having described my invention, I claim:

1. An integrated arm support and mouse table configured to be attached to a chair having an arm rest and a back, comprising:

a. a mounting unit, including attachment means for attaching said mounting unit to said arm rest of said chair, and a horizontal pivot joint, wherein said mounting unit includes
   i. a top wall, positioned to be placed over said arm rest,
   ii. a side wall connected to said top wall, and positioned to be placed next to said arm rest,
   iii. at least one strap, having a first end and a second end, wherein said first end is affixed to said mounting unit and said second end is free, and
   iv. at least one lock, attached to said mounting unit, and positioned so that said second end of said at least one strap can be passed around said arm rest of said chair, drawn tight, and locked into said at lease one lock, thereby attaching said mounting unit to said arm rest;

b. a pivot bracket, pivotally attached to said mounting unit by said horizontal pivot joint, wherein said pivot bracket further includes an angled pivot joint;

c. an arm support, pivotally attached to said pivot bracket by said angled pivot joint, wherein said arm support includes
   i. an arm rest cover, configured to fit over said arm rest of said chair, and
   ii. a table attached to said arm rest cover, and being positioned distal from said back of said chair; and d. wherein said arm rest cover opens into a forearm channel shaped to receive a forearm of said user, and wherein
   i. said first end of said at least one strap is attached to said top wall,
   ii. said side wall includes at least one strap journal positioned proximate said top wall,
   iii. said at least one lock is attached to said side wall distal to said top wall, and
   iv. after said second end of said at least one strap is passed around said arm rest, and before said second end of said at least one strap is locked into said at least one lock said second end of said at least one strap is passed around said at least one strap journal.

2. An integrated arm support and mouse table as recited in claim 1, wherein said arm support, when in use, lies in a substantially horizontal orientation, and wherein said table is separated from said arm rest cover by a vertical offset.

3. An integrated arm support and mouse table as recited in claim 2, wherein:

a. said vertical offset opens into a wrist channel to receive a wrist of said user; and b. said forearm channel and said wrist channel are joined.

4. An integrated arm support and mouse table as recited in claim 3, wherein said table is inclined with respect to said arm cover.

5. An integrated arm support and mouse table as recited in claim 3, wherein:

a. said pivot bracket includes an upper surface;

b. said angled pivot joint is proximate said upper surface of said pivot bracket;

c. said pivot bracket is capable of pivoting so that said upper surface of said pivot bracket lies in a horizontal orientation; and d. when said upper surface of said pivot bracket is in said horizontal orientation; said angled pivot joint is angularly offset from said arm rest of said chair.

6. An integrated arm support and mouse table as recited in claim 3, wherein said mounting unit comprises:

a. a top wall, positioned to be placed over said arm rest;

b. a side wall connected to said top wall, and positioned to be placed next to said arm rest;

c. at least one strap, having a first end and a second end, wherein said first end is affixed to said mounting unit and said second is free; and d. at least one lock, attached to said mounting unit, and positioned so that said second end of said at least one strap can be passed around said arm rest of said chair, drawn tight, and locked into said at least one lock, thereby attaching said mounting unit to said arm rest.

7. An integrated arm support and table as recited in claim 3, wherein said mouse table further comprises an upward facing surface and a recess cut into said upward facing surface.

8. An integrated arm support and mouse table as recited in claim 2, wherein said table is inclined with respect to said arm rest cover.

9. An integrated arm support and mouse table as recited in claim 8, wherein:

a. said pivot bracket includes an upper surface;

b. said angled pivot joint is proximate said upper surface of said pivot bracket;

c. said pivot bracket is capable of pivoting so that said upper surface of said pivot bracket lies in a horizontal orientation; and d. when said upper surface of said pivot bracket is in said horizontal orientation, said angled pivot joint is angularly offset from said arm rest of said chair.

10. An integrated arm support and mouse table as recited in claim 8, wherein said mounting unit comprises:

a. a top wall, positioned to be placed over said arm rest;

b. a side wall connected to said top wall, and positioned to be placed next to said arm rest;

c. at least one strap, having a first end and a second end, wherein said first end is affixed to said mounting unit and said second end is free; and d. at least one lock, attached to said mounting unit, and positioned so that said second end of said at least one strap can be passed around said arm rest of said chair, drawn tight, and locked into said at least one lock, thereby attaching said mounting unit to said arm rest.

11. An integrated arm support and mouse table as recited in claim 2, wherein:

a. said pivot bracket includes an upper surface;
b. said angled pivot joint is proximate said upper surface of said pivot bracket;
c. said pivot bracket is capable of pivoting so that said upper surface of said pivot bracket lies in a horizontal orientation; and
d. when said upper surface of said pivot bracket is in said horizontal orientation, said angled pivot joint is angularly offset from arm rest of said chair.

12. An integrated arm support and mouse table recited in claim 11, wherein said mounting unit comprises:
a. a top wall, positioned to be placed over said arm rest;
b. a side wall connected to said top wall, and positioned to be placed next to said arm rest;
c. at least one strap, having a first end and a second end, wherein said first end is affixed to said mounting unit and said second end is free; and
d. at least one lock, attached to said mounting unit, and positioned so that said second end of said at least one strap can be passed around said arm rest of said chair, drawn tight, and locked into said at least one lock, thereby attaching said mounting unit to said arm rest.

13. An integrated arm support and mouse table as recited in claim 2, wherein said mounting unit comprises:
a. a top wall, positioned to be placed over said arm rest;
b. a side wall connected to said top wall, and positioned to be placed next to said arm rest;
c. at least one strap, having first end and a second end, wherein said first end is affixed to said mounting unit and said second end is free;
d. at least one lock, attached to said mounting unit, and positioned so that said second end of said at least one strap can be passed around said arm rest of said chair, drawn tight, and locked into said at least one lock, thereby attaching said mounting unit to said arm rest.

14. An integrated arm support and mouse table as recited in claim 2, wherein said table further comprises an upward facing surface and a recess cut into said upward facing surface.

15. An integrated arm support and mouse table as recited in claim 1, wherein:
a. said pivot bracket includes an upper surface;
b. said angled pivot joint is proximate said upper surface of said pivot bracket;
c. said pivot bracket is capable of pivoting so that said upper surface of said pivot bracket lies in a horizontal orientation; and
d. when said upper surface of said pivot bracket is in said horizontal orientation, said angled pivot joint is angularly offset from said arm rest of said chair.

16. An integrated arm support and mouse table as recited in claim 15, wherein said mounting unit comprises:
a. a top wall, positioned to be placed over said arm rest;
b. a side wall connected to said top wall, and positioned to be placed next to said arm rest;
c. at least one strap, having a first end and a second end, wherein said first end is affixed to said mounting unit and said second end is free; and
d. at least one lock, attached to said mounting unit, and positioned so that said second end of said at least one strap can be passed around said arm rest of said chair drawn tight, and locked into said at least one lock thereby attaching said mounting unit to said arm rest.

17. An integrated arm support and mouse table as recited in claim 1, wherein said table further comprises an upward facing surface and a recess cut into said upward facing surface.

18. An integrated arm support and mouse table configured to be attached to a chair having an arm rest and a back, comprising:
a. a mounting unit, including attachment means for attaching said mounting unit to said arm rest of said chair, and a horizontal pivot joint, wherein said mounting unit includes
   i. a top wall, positioned to be placed over said arm rest,
   ii. a side wall connected to said top wall, and positioned to be placed next to said arm rest,
   iii. at least one strap, having a first end and a second end, wherein said first end is affixed to said mounting unit and said second end is free, and
   iv. at least one lock, attached to said mounting unit, and positioned so that said second end of said at least one strap can be passed around said arm rest of said chair, drawn tight, and locked into said at lease one lock, thereby attaching said mounting unit to said arm rest;
b. a pivot bracket, pivotally attached to said mounting unit by said horizontal pivot joint, wherein said pivot bracket further includes an angled pivot joint;
c. an arm support, pivotally attached to said pivot bracket by said angled pivot joint, wherein said arm support includes
   i. an arm rest cover, configured to fit over said arm rest of said chair, and
   ii. a table attached to said arm rest cover, and being positioned distal from said back of said chair; and
d. wherein said arm support, when in use, lies in a substantially horizontal orientation, wherein said table is separated from said arm rest cover by a vertical offset, and wherein
   i. said first end of said at least one strap is attached to said top wall,
   ii. said side wall includes at least one strap journal positioned proximate said top wall,
   iii. said at least one lock is attached to said side wall distal to said top wall, and
   iv. after said second end of said at least one strap is passed around said arm rest, and before said second end of said at least one strap is locked into said at least one lock said second end of said at least one strap is passed around said at least one strap journal.

* * * * *